US011480988B2

(12) United States Patent
Arno

(10) Patent No.: US 11,480,988 B2
(45) Date of Patent: Oct. 25, 2022

(54) VOLTAGE CONTROL DEVICE

(71) Applicant: STMicroelectronics (Alps) SAS, Grenoble (FR)

(72) Inventor: Patrik Arno, Sassenage (FR)

(73) Assignee: STMicroelectronics (Alps) SAS, Grenoble (FR)

( * ) Notice: Subject to any disclaimer, the term of this patent is extended or adjusted under 35 U.S.C. 154(b) by 780 days.

(21) Appl. No.: 15/364,454

(22) Filed: Nov. 30, 2016

(65) Prior Publication Data

US 2017/0351286 A1 Dec. 7, 2017

(30) Foreign Application Priority Data

Jun. 6, 2016 (FR) ..... 1655151

(51) Int. Cl.
*G05F 1/625* (2006.01)
*G05F 3/26* (2006.01)
*G05F 1/56* (2006.01)

(52) U.S. Cl.
CPC ..... *G05F 1/625* (2013.01); *G05F 1/56* (2013.01); *G05F 3/262* (2013.01)

(58) Field of Classification Search
CPC . G05F 1/56; G05F 1/461; G05F 1/625; G05F 3/262
See application file for complete search history.

(56) References Cited

U.S. PATENT DOCUMENTS 7,138,868 B2 * 11/2006 Sanchez ..... H03F 3/45183 330/256
7,218,168 B1 * 5/2007 Rahman ..... G05F 1/56 323/273
7,265,608 B1 * 9/2007 Lu ..... G05F 1/46 323/313
9,069,369 B1 * 6/2015 Liu ..... G05F 1/56
9,958,887 B2 * 5/2018 Ikeda ..... G05F 1/461
2002/0063576 A1 5/2002 Kim et al.
2005/0212484 A1 9/2005 Denning et al.
2013/0120177 A1 5/2013 Keramat et al.

FOREIGN PATENT DOCUMENTS

CN 1674403 A 9/2005
CN 103235633 A 8/2013
CN 103455073 A 12/2013
CN 206741348 U 12/2017
EP 2221960 A1 8/2010
WO 2006054217 A2 5/2006

* cited by examiner

*Primary Examiner* — Menatoallah Youssef
*Assistant Examiner* — Colleen J O Toole
(74) *Attorney, Agent, or Firm* — Slater Matsil, LLP

(57) ABSTRACT

A device for controlling a first voltage with a second voltage includes a first terminal of application of the second voltage and a second terminal for supplying the first voltage. A comparator has a first input terminal connected to the first terminal and has a second input terminal receiving information representative of the first voltage. At least one first current source of programmable intensity is connected to the second input terminal of the comparator.

21 Claims, 2 Drawing Sheets

VOLTAGE CONTROL DEVICE

CROSS-REFERENCE TO RELATED APPLICATIONS

This application claims priority to French Patent Application No. 1655151, filed on Jun. 6, 2016, which application is hereby incorporated herein by reference.

TECHNICAL FIELD

The present disclosure generally relates to electronic circuits, and more particularly to devices which achieve a control of a voltage with another voltage.

BACKGROUND

Devices which achieve the control of a voltage with another one generally comprise a gain stage, which may be programmable to adjust the value of the controlled voltage according to the needs of the application.

The electronic components undergo variations of their electric quantities due to variations of the manufacturing methods. In the case of controlled systems, such variations are generally also compensated by the programmable-gain stage.

The use of the programmable-gain stage for purposes which may be contradictory induces the need for a compromise.

Further, compensating the variations of manufacturing methods may be a method which is complex or expensive to implement in a production context.

There is a need to improve the compensation of variations due to the manufacturing methods without limiting the possibility of adjustment of the controlled voltage.

SUMMARY

Thus, an embodiment provides overcoming all or part of the disadvantages of current solutions, by making the gain adjustment and the compensation of variations due to the manufacturing methods independent from one another.

Another embodiment enables to compensate the effects of manufacturing methods independently from the gain due to a calibration factor having a positive sign.

Another embodiment enables to compensate the effects of manufacturing methods due to a calibration factor having a programmable sign.

Thus, an embodiment provides a device for controlling a first voltage with a second voltage. The device includes a first terminal for application of the second voltage and a second terminal for supplying the first voltage. A comparator has a first input terminal connected to the first terminal and a second input terminal configured to receive information representative of the first voltage. At least one first current source of programmable intensity is connected to the second input terminal of the comparator.

According to an embodiment, the value of the current of the first current source is proportional to the ratio of the second voltage to a resistance.

According to an embodiment, the first current source is coupled between a first terminal of application of a first voltage and the second input terminal.

According to an embodiment, the device further comprises a second programmable current source, coupled between a second terminal of application of a second voltage and the second input terminal.

According to an embodiment, the programmable current source(s) each comprise first branch comprising a reference current source and a first diode-assembled transistor, in series between one or the first terminal of application of a first voltage and one or the second terminal of application of a second voltage, and at least one second branch comprising a programmable switch and a second transistor, in series between one of the first and second terminals of application of a voltage and the second input terminal. The gate of the second transistor is coupled to that of the first transistor.

According to an embodiment, the first terminal of application of the first voltage is coupled to a power supply voltage.

According to an embodiment, the power supply voltage is the ground.

According to an embodiment, the first current source comprises a resistor of programmable value having a first terminal connected to a terminal of application of a power supply voltage, and having a second terminal connected to the second terminal of the comparator.

According to an embodiment, the first current source comprises in series between a terminal of application of a ground voltage and the second terminal of the comparator, a voltage source of programmable value and a resistor.

The foregoing and other features and advantages will be discussed in detail in the following non-limiting description of dedicated embodiments in connection with the accompanying drawings.

DETAILED DESCRIPTION OF ILLUSTRATIVE EMBODIMENTS

Figure 1:
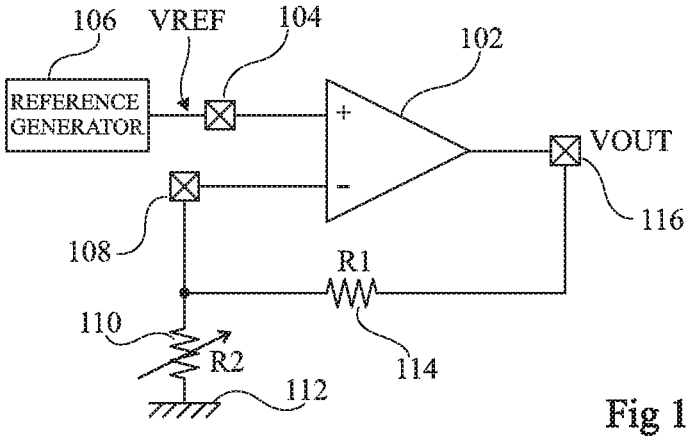
FIG. 1 shows an example of a usual device for controlling a voltage with another voltage.

The same elements have been designated with the same reference numerals in the different drawings. For clarity, only those elements which are useful to the understanding of the described embodiments have been shown and are detailed.

Unless otherwise specified, expressions "approximately", "substantially", and "in the order of" mean to within 10%, preferably to within 5%.

FIG. 1 shows a usual example of a device controlling a voltage with another voltage.

The device comprises an operational amplifier 102, having a non-inverting input terminal 104 coupled to a generator 106 (REFERENCE GENERATOR) of a reference voltage VREF. An inverting input terminal 108 of amplifier 102 is coupled on the one hand to a resistor no, which will be called foot resistor, of programmable value R2, connected to a terminal 112 of application of a reference voltage, for example, ground GND, and on the other hand to a resistor 114 of value R1, connected to an output terminal 116 of the amplifier.

Voltage value Vout generated on output terminal 116 of amplifier 102 is obtained by the following equation:

$$V\text{out}=V\text{REF}\cdot(1+R1/R2) \quad \text{(Equation 1).}$$

The gain linking voltage Vout to voltage VREF thus is G=(1+R1/R2).

Due to equation 1, the variation of value R2 of the foot resistance causes the variation of gain G, which enables to adjust the value of voltage Vout generated on output terminal 116 of amplifier 102.

In reality, due to variations due to the manufacturing methods, generator 106 supplies reference voltage VREF tainted with an error of value+/−DVREF.

Similarly, amplifier 102 has imperfections which translate as offset voltages on its inputs. Such offset voltages may be modeled by a voltage generator (not shown) of value+/−DVOS in series between generator 106 and terminal 104.

The value of output voltage Vout then becomes:

$$Vout=VREF\cdot(1+R1/R2)+(+/-DVREF+/-DVOS)\cdot(1+R1/R2) \quad \text{(Equation 2)},$$

or:

$$Vout=VREF\cdot(1+R1/R2)+Error\cdot(1+R1/R2) \quad \text{(Equation 3)},$$

$$\text{with } Error=+/-DVREF+/-DVOS \quad \text{(Equation 4)}.$$

Equation 3 differs from equation 1 by term Error·(1+R1/R2) resulting from the sum of the errors due to the manufacturing methods multiplied by gain G. This error term, which adds to the value of the output voltage, should be compensated for.

By varying value R2 of the foot resistor, one may decrease, or even suppress, the contribution of the error term to the obtaining of the value of the output voltage. This however has an influence on the gain, such a compensation may thus be contradictory with the possibility of freely adjusting the gain for the needs of the application.

It is thus not possible to efficiently independently vary the gain and the compensation.

Another disadvantage of such a compensation method is the fact that the compensation or calibration function is non-linear, since the value of the output voltage varies inversely proportionally to the foot resistance. Such a non-linearity makes the calibration complex and may be expensive to implement in a production context.

Figure 2:
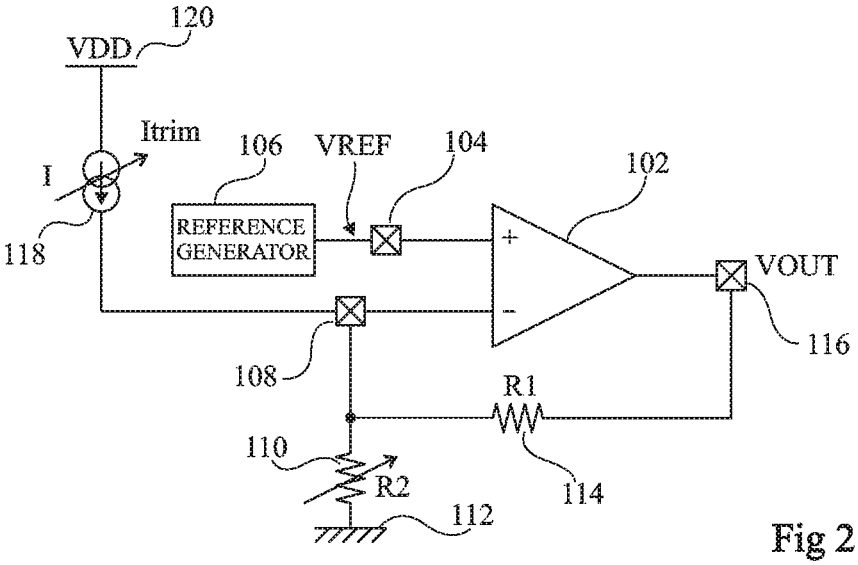
FIG. 2 shows an embodiment of a device for controlling a voltage with another voltage.

FIG. 2 shows an embodiment of a device controlling a voltage with another voltage.

As compared with the device of FIG. 1, the device of FIG. 2 comprises a current source 118 (I) of programmable intensity Itrim, connected on the one hand to the inverting input terminal 108 of amplifier 104 and on the other hand to a terminal 120 of application of a power supply voltage VDD.

The introduction of current source 118 modifies equation 3, which becomes the following equation:

$$Vout=VREF\cdot(1+R1/R2)+Error\cdot(1+R1/R2)-Itrim\cdot R1 \quad \text{(Equation 5)},$$

where −Itrim·R1 defines a calibration factor.

According to equation 5, by varying the value of intensity Itrim of current source 118, one may compensate, or even cancel, error term Error·(1+R1/R2), and this with no influence on the value of gain (1+R1/R2).

A device for controlling a voltage with another voltage for which the gain adjustment and the compensation of variations due to the manufacturing processes can be performed independently has thus been formed.

In another embodiment, current source 118 of FIG. 2 is connected on the one hand to reference terminal 112 and on the other hand to inverting terminal 108 of the amplifier.

The following equation is then obtained:

$$Vout=VREF\cdot(1+R1/R2)+Error\cdot(1+R1/R2)+Itrim\cdot R1 \quad \text{(Equation 6)},$$

The current source then compensates the error term, with a sign inverted with respect to equation 5.

Figure 3:
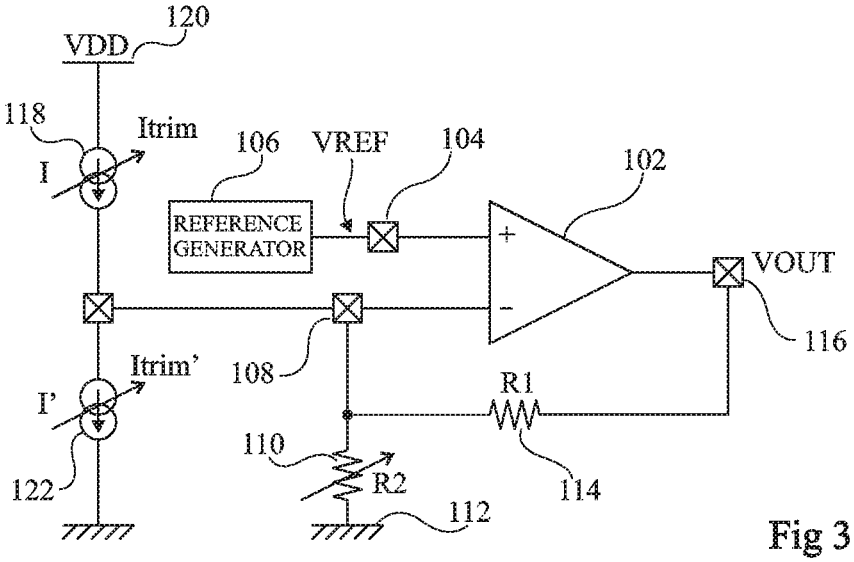
FIG. 3 shows another embodiment of a device for controlling a voltage with another voltage.

FIG. 3 describes an embodiment combining the two previous embodiments. As compared with the device of FIG. 2, a second current source 122 (I') of programmable intensity Itrim' is connected on the one hand to terminal 112 and on the other hand to terminal 108.

In this embodiment, one or the other of the current sources is active for the compensation. This has the advantage of giving the user the possibility of injecting or of sampling current into or from the loop according to the sign of the value of the error term.

As a variation, programmable current source 118 is made in the form of a resistor of variable value connected between terminals 120 and 108.

According to another variation, current source 122 is made in the form of a variable voltage generator and of a resistor, in series between terminals 112 and 108.

Figure 4:
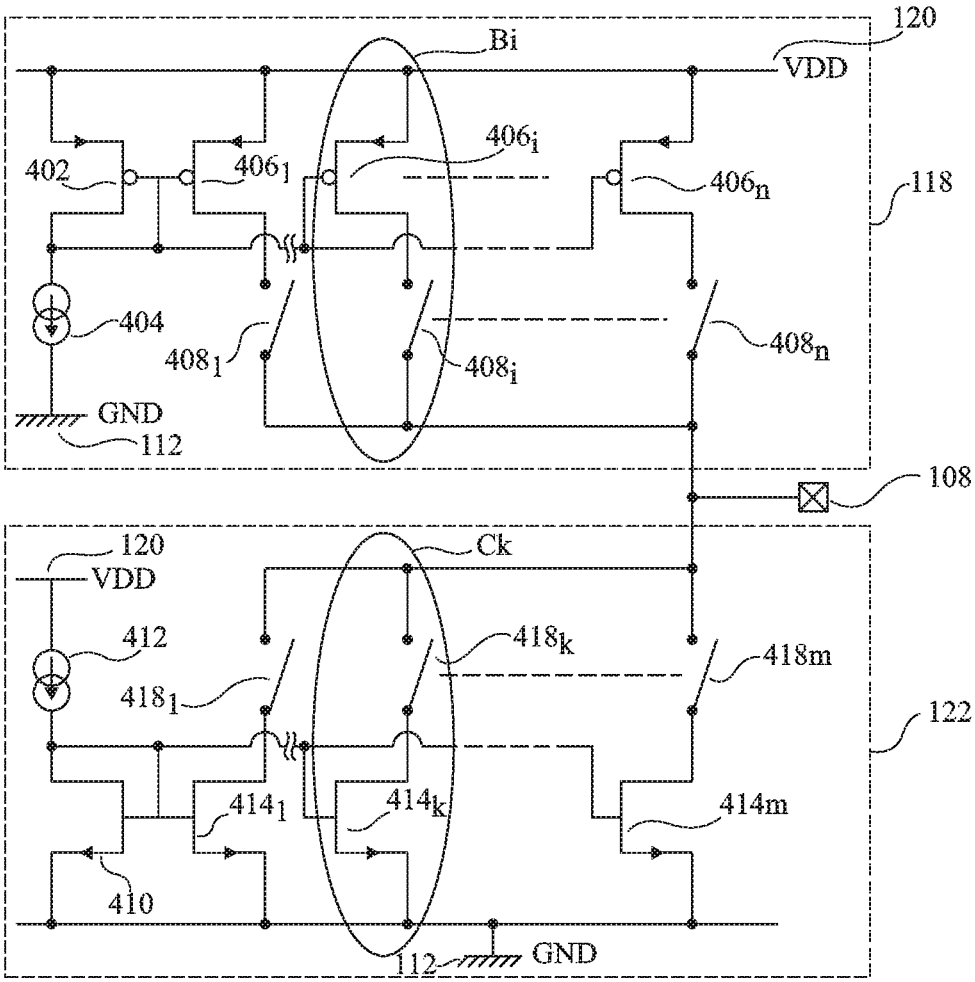
FIG. 4 shows an embodiment of a current source used in the devices of FIGS. 2 and 3.

FIG. 4 describes an embodiment of the two current sources 118 and 122 used in the previous embodiments.

Current source 118 comprises a first branch comprising, in series between terminal 120 of application of power supply voltage VDD and terminal 112 of application of the ground, a diode-assembled PMOS-type transistor 402 and a first reference current source 404. The current source 118 also comprises one or a plurality of other branches Bi, with i varying from 1 to n, comprising, in series between terminal 120 and terminal 108 of the amplifier, a PMOS-type transistor 406, having its gate connected to that of transistor 402, and a switch $\mathbf{408}_i$.

Current source 122 comprises a first branch comprising in series between terminal 120 and terminal 112 a diode-assembled NMOS-type transistor 410 and a second reference current source 412. The current source 122 also comprises one or a plurality of other branches Ck, with k varying from 1 to m, each comprising in series between terminal 108 and terminal 112 a switch $\mathbf{418}_k$ and an NMOS-type transistor $\mathbf{414}_k$. All the gates of transistors $\mathbf{414}_k$ are connected together to the gate of transistor 410.

The respective states of the different switches are programmed to obtain the current intensity desired for the compensation.

It should be noted that for each current source, the number of branches and the surface area ratios between the transistors of the different branches are selected according to the needs of the application.

In an embodiment, current sources 404 and 412 are generated by dividing reference voltage VREF with a resistance of value R, of same nature as resistors 110 and 114 of FIGS. 2 and 3.

The value of the current intensity is then obtained by the following equation:

$$Itrim=\alpha(VREF+/-DVREF)/R \quad \text{(Equation 7)},$$

where α is a coefficient independent, as a first approximation, from variations due to the manufacturing methods.

Equation 5 then becomes:

$$Vout=VREF\cdot(1+R1/R2)+Error\cdot(1+R1/R2)-\alpha\cdot(VREF+/-DVREF)\cdot R1/R \quad \text{(Equation 8)},$$

with α·(VREF+/−DVREF)·R1/R defining the calibration factor.

In this embodiment, the calibration then advantageously becomes independent, at the first order, from variations due to the resistor manufacturing methods.

Specific embodiments have been described. Various alterations, modifications, and improvements will occur to those skilled in the art. Although embodiments comprising amplifiers have in particular been described, any circuit of comparator type may be used.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A device for controlling a first voltage with a second voltage, the device comprising:

a first terminal configured to receive the second voltage;

a second terminal configured to supply the first voltage;

a comparator having a first input terminal connected to the first terminal and a second input terminal configured to receive information representative of the first voltage;

a current source of programmable intensity connected to the second input terminal;

a variable resistor coupled between the second input terminal and a first supply terminal; and a resistor coupled between the second terminal and the second input terminal, wherein the device is configured to cancel a voltage offset at the second terminal by adjusting a compensation current supplied by the current source and without changing a resistance of the variable resistor, wherein the first voltage is substantially equal to the second voltage times a gain plus the voltage offset.

2. The device of claim 1, wherein the current source is configured to generate a current that is proportional to a ratio of the second voltage to a resistance.

3. The device of claim 1, wherein the current source is coupled between the first supply terminal or a second supply terminal and the second input terminal.

4. The device of claim 3, wherein the first supply terminal is configured to receive a power supply voltage.

5. The device of claim 4, wherein the power supply voltage is ground.

6. The device of claim 1, wherein the current source comprises:

a first branch comprising a reference current source and a first transistor, the first transistor having a current path that is coupled in series with the reference current source; and a second branch comprising a programmable switch and a second transistor, the second transistor having a current path that is coupled in series with the programmable switch, wherein the current path of the second transistor is coupled to the second input terminal, and wherein a control terminal of the second transistor is coupled to a control terminal of the first transistor.

7. The device of claim 6, further comprising a second current source of programmable intensity coupled between a second supply terminal and the second input terminal, wherein the current source is coupled between the first supply terminal and the second input terminal.

8. The device of claim 7, wherein the second current source comprises:

a first branch comprising a second reference current source and a third transistor, the third transistor having a current path that is coupled in series with the second reference current source; and a second branch comprising a second programmable switch and a fourth transistor, the fourth transistor having a current path that is coupled in series with the second programmable switch, wherein the current path of the fourth transistor is coupled to the second input terminal, and wherein a control terminal of the fourth transistor is coupled to a control terminal of the third transistor.

9. The device of claim 1, wherein the current source comprises a programmable voltage source and a resistor coupled in series between a ground terminal and the second terminal of the comparator.

10. A circuit comprising:

a comparator having a first input, a second input, and an output configured to produce an output voltage;

a resistor coupled between the output of the comparator and the second input of the comparator;

a reference voltage generator coupled to the first input of the comparator and configured to generate a reference voltage;

a programmable current source coupled between a first reference voltage terminal and the second input of the comparator; and a variable resistor coupled between the second input of the comparator and a first supply terminal, wherein the circuit is configured to cancel a voltage offset at the output of the comparator by adjusting a compensation current supplied by the programmable current source and without changing a resistance of the variable resistor, wherein the output voltage is substantially equal to the reference voltage times a gain plus the voltage offset.

11. The circuit of claim 10, further comprising a second programmable current source coupled between a second reference voltage terminal and the second input of the comparator.

12. The circuit of claim 10, wherein the programmable current source comprises:

a first branch comprising a diode-coupled transistor in series with a reference current source, the first branch coupled between the first reference voltage terminal and a second reference voltage terminal; and a second branch comprising a programmable switch in series with a second transistor, the second branch coupled between the first reference voltage terminal and the second input of the comparator.

13. The circuit of claim 12, wherein the programmable current source further comprises a third branch comprising a second programmable switch in series with a third transistor, the second branch coupled between the first reference voltage terminal and the second input of the comparator.

14. A circuit comprising:

a comparator having a first input, a second input, and an output configured to produce an output voltage;

a resistor coupled between the output of the comparator and the second input of the comparator;

a reference voltage generator coupled to the first input of the comparator and configured to generate a reference voltage;

a first programmable current source coupled between a first reference voltage terminal and the second input of the comparator;

a second programmable current source coupled between a second reference voltage terminal and the second input of the comparator; and a variable resistor coupled between the second input of the comparator and the second reference voltage terminal, wherein the circuit is configured to cancel a voltage offset at the output of the comparator by adjusting a compensation current supplied by the first or second programmable current sources and without changing a resistance of the variable resistor, wherein the output voltage is substantially equal to the reference voltage times a gain plus the voltage offset.

15. The circuit of claim 14, wherein the first programmable current source comprises:

a first branch comprising a diode-coupled transistor in series with a reference current source, the first branch coupled between the first reference voltage terminal and the second reference voltage terminal; and a second branch comprising a programmable switch in series with a second transistor, the second branch coupled between the first reference voltage terminal and the second input of the comparator, the second transistor having a gate coupled to a gate of the diode-coupled transistor.

16. The circuit of claim 15, wherein the first programmable current source further comprises a third branch comprising a second programmable switch in series with a third transistor, the second branch coupled between the first reference voltage terminal and the second input of the comparator, the third transistor having a gate coupled to the gate of the second transistor.

17. The circuit of claim 15, wherein the second programmable current source comprises:

a first branch comprising a second diode-coupled transistor in series with a second reference current source, the first branch coupled between the first reference voltage terminal and the second reference voltage terminal; and a second branch comprising a second programmable switch in series with a third transistor, the second branch coupled between the second reference voltage terminal and the second input of the comparator, the third transistor having a gate coupled to a gate of the second diode-coupled transistor.

18. The circuit of claim 14, wherein the first reference voltage terminal is a VDD terminal and the second reference voltage terminal is a ground terminal.

19. The circuit of claim 10, wherein the resistor is directly connected between the output of the comparator and the second input of the comparator.

20. The circuit of claim 14, wherein the resistor is directly connected between the output of the comparator and the second input of the comparator.

21. The device of claim 1, wherein an output of the comparator is connected to the second input terminal via the resistor.

* * * * *